US007744455B2

(12) United States Patent
Aida

(10) Patent No.: US 7,744,455 B2
(45) Date of Patent: Jun. 29, 2010

(54) GAME MACHINE

(75) Inventor: Eiji Aida, Tokyo (JP)

(73) Assignee: Konami Gaming Incorporated, Las Vegas, NV (US)

( * ) Notice: Subject to any disclaimer, the term of this patent is extended or adjusted under 35 U.S.C. 154(b) by 500 days.

(21) Appl. No.: 11/275,728

(22) Filed: Jan. 26, 2006

(65) Prior Publication Data

US 2007/0173307 A1 Jul. 26, 2007

(51) Int. Cl.
*A63F 9/24* (2006.01)

(52) U.S. Cl. ..... 463/16; 463/20; 463/30; 463/31

(58) Field of Classification Search ..... 463/16, 463/20, 30, 31
See application file for complete search history.

(56) References Cited

U.S. PATENT DOCUMENTS 6,554,704 B2 * 4/2003 Nicastro et al. ..... 463/20
6,905,405 B2 * 6/2005 McClintic ..... 463/16
7,419,431 B2 * 9/2008 Gauselmann et al. ..... 463/30

* cited by examiner

*Primary Examiner*—Peter DungBa
*Assistant Examiner*—Omkar Deodhar
(74) *Attorney, Agent, or Firm*—Global IP Counselors, LLP

(57) ABSTRACT

A game machine is disclosed which includes a display unit, a memory unit which stores a cell array and a plurality of game symbols, a display control unit, and a game control unit. The display control unit displays the cell array, a peripheral region surrounding the cell array, and the plurality of game symbols on the display unit, animates the plurality of game symbols so that the plurality of game symbols move across the cell array and the peripheral region along trajectories that include curved trajectories, and positions and displays a static combination of game symbols in the cell array. The game control unit selects the static combination of game symbols to be displayed in the cell array, and determines whether a winning combination of game symbols will be included in the static combination of game symbols.

26 Claims, 7 Drawing Sheets

GAME MACHINE

BACKGROUND OF THE INVENTION

1. Field of the Invention

The present invention generally relates to a game machine, and more particularly to a game machine and program that electronically implement wagering games on a display device.

2. Background Information

Game machines that electronically implement wagering games such as video slots, video poker, video blackjack, video keno, video bingo, video pachinko, video lottery, and the like, are well known in the gaming industry. Slot games provided by either video slot machines or mechanical spinning reel slot machines have proven to be one of the most popular of these wagering games.

In the typical slot machine found in many casinos throughout the world, a play field, video screen, or other display means displays a plurality of three, four, or five real or virtual reels that rotate vertically during play. Each reel contains at least one game symbol which, upon stoppage of the reel's rotation, may align with one or more paylines. The symbols aligned along a particular payline, when compared to a pay table, will determine the result of a bet placed by a player beforehand.

Slot machine designers continually seek ways to improve game play and reduce player boredom, and thereby increase revenue per player. A variety of strategies have been tried in the past to make slot machines more entertaining to players, but the prior art arrangement of reels, game symbols, and paylines is rather limiting in that the direction in which the symbols travel prior to stoppage is entirely predictable. This predictability ultimately leads to player boredom, and lower gaming revenues.

In view of the above, it will be apparent to those skilled in the art from this disclosure that there exists a need for an improved game machine that provides a more entertaining experience for a player. This invention addresses this need in the art as well as other needs, which will become apparent to those skilled in the art from this disclosure.

SUMMARY OF THE INVENTION

According to one aspect of the present invention, a game machine comprises a display unit, a memory unit which stores a cell array and a plurality of game symbols, a display control unit, and a game control unit. The display control unit displays the cell array, a peripheral region surrounding the cell array, and the plurality of game symbols on the display unit, animates the plurality of game symbols so that the plurality of game symbols move across the cell array and the peripheral region along trajectories that include curved trajectories, and positions and displays a static combination of game symbols in the cell array. The game control unit selects the static combination of game symbols to be displayed in the cell array, and determines whether a winning combination of game symbols will be included in the static combination of game symbols.

According to another aspect of the present invention, the game control unit selects the static combination of game symbols, and the sequence in which the static combination of game symbols are to be displayed on the cell array, at the moment that a player starts a game operation after placing a bet.

According to another aspect of the present invention, the plurality of game symbols includes a plurality of dummy game symbols.

According to another aspect of the present invention, the game control unit mixes the static combination of game symbols with the plurality of dummy game symbols at the moment that the player starts game play after placing a bet.

According to another aspect of the present invention, the game control unit randomly separates the static combination of game symbols into groups each consisting of one or more game symbols, and randomly separates the plurality of dummy game symbols into groups each consisting of one or more game symbols, prior to mixing the static combination of game symbols with the plurality of dummy game symbols.

According to another aspect of the present invention, the plurality of game symbols move on the display unit independent of each other and/or in groups of two or more.

According to another aspect of the present invention, each game symbol in a group of two or more game symbols is capable of moving with respect to the other game symbols in the group.

According to another aspect of the present invention, the display control unit displays a virtual three-dimensional space on the display unit.

According to another aspect of the present invention, the plurality of game symbols are capable of at least one movement within the virtual three-dimensional space that is selected from the group consisting of revolving, rotating, twisting, and zig-zagging.

According to another aspect of the present invention, the cell array is one selected from the group consisting of a matrix shape, a honeycomb shape, a ring shape, and an amorphous shape.

According to another aspect of the present invention, the plurality of game symbols are displayed on the display unit so as to continuously move from the peripheral region to the cell array prior to the static combination of game symbols being displayed in the cell array.

According to another aspect of the present invention, the plurality of game symbols are not displayed in the peripheral region when the static combination of game symbols is displayed in the cell array.

According to another aspect of the present invention, the plurality of game symbols are capable of moving in non-vertical and non-horizontal trajectories in the peripheral region.

According to another aspect of the present invention, the plurality of game symbols are capable of moving in linear and/or curved trajectories in the cell array.

According to another aspect of the present invention, a computer readable medium stores computer-executable instructions for performing steps comprising: (a) displaying a cell array and a plurality of game symbols on a display unit; (b) animating the plurality of game symbols on the display unit so that the plurality of game symbols move in a plurality of linear and non-linear directions; (c) selecting a static combination of game symbols to be displayed in the cell array from the plurality of game symbols; and (d) positioning and displaying the static combination of game symbols in the cell array.

According to another aspect of the present invention, the computer-executable instructions determine the static combination of game symbols to be selected, and the sequence in which the static combination of game symbols are to be displayed on the cell array, at the moment that a player starts game play after placing a bet.

According to another aspect of the present invention, the plurality of game symbols includes a plurality of dummy game symbols.

According to another aspect of the present invention, the computer-executable instructions mix the static combination of game symbols with the plurality of dummy game symbols at the moment that a player starts game play after placing a bet.

According to another aspect of the present invention, the computer-executable instructions randomly separate the static combination of game symbols into groups consisting of one or more game symbols, and randomly separate the plurality of dummy game symbols into groups of one or more game symbols, prior to mixing the static combination of game symbols with the plurality of dummy game symbols.

According to another aspect of the present invention, the plurality of game symbols move on the display unit independent of each other and/or in groups of two or more.

According to another aspect of the present invention, each game symbol in a group of two or more game symbols is capable of moving with respect to the other game symbols in the group.

According to another aspect of the present invention, the computer-executable instructions are capable of displaying a virtual three-dimensional space on the display unit.

According to another aspect of the present invention, the plurality of game symbols are capable of at least one movement within the virtual three-dimensional space that is selected from the group consisting of revolving, rotating, twisting, and zig-zagging.

According to another aspect of the present invention, the cell array is one selected from the group consisting of a matrix shape, a honeycomb shape, a ring shape, and an amorphous shape.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Overall configuration of the game machine

Figure 1:
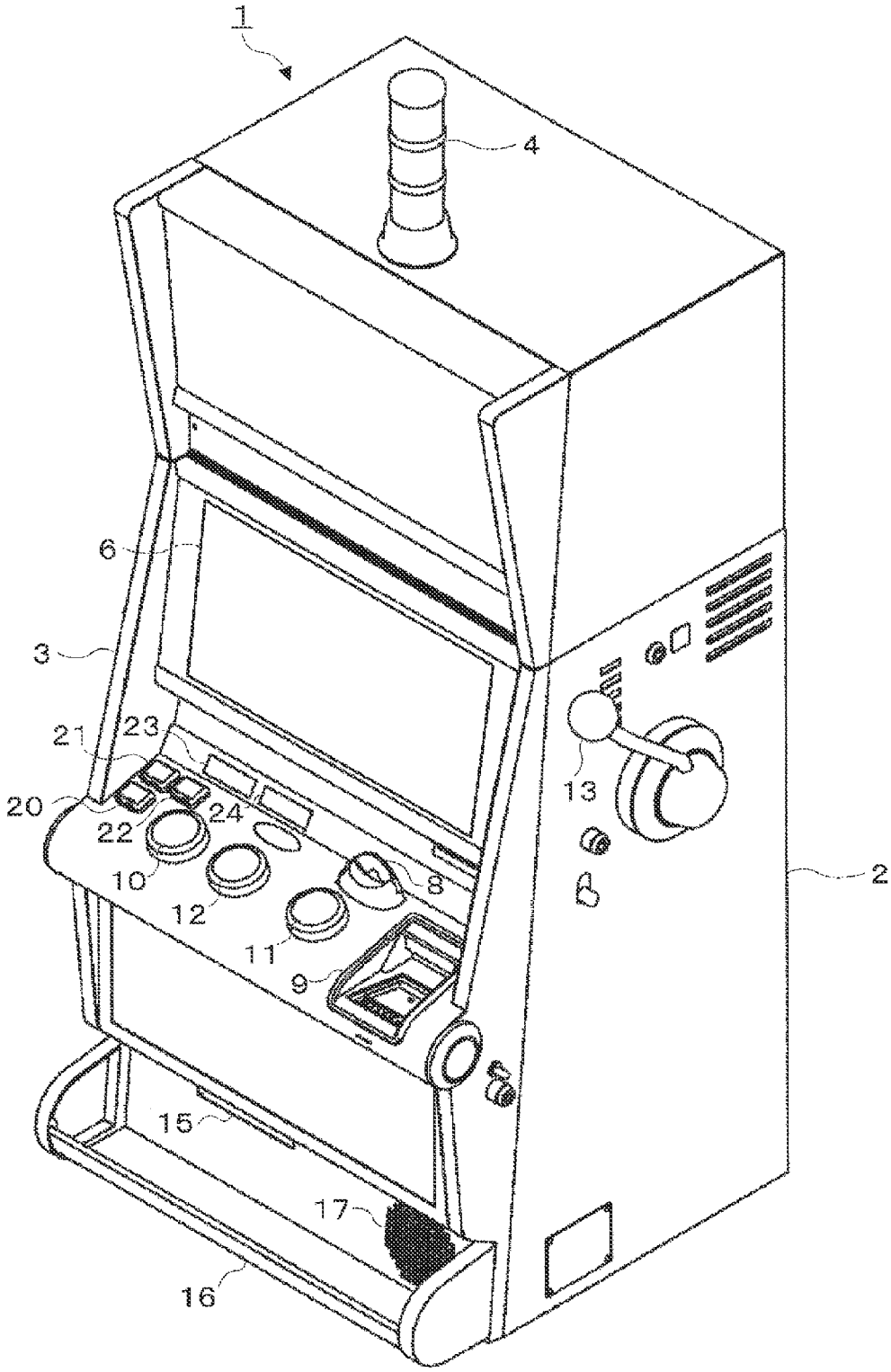
FIG. 1 shows an exterior view of a game machine according to an embodiment of the present invention.

Referring initially to FIG. 1, a game machine 1 is comprised of a case 2, and a front panel 3 that is hingedly attached to the front of the case 2 so that the interior of the case 2 can be accessed. A lamp 4 is arranged on the top of the case. A display unit 6 is disposed on the front panel 3, and includes a display device that may be implemented as a CRT, an LCD, a plasma display, an organic liquid crystal display, or other type of video display suitable for use in a game machine, and may further included a touch screen. In addition, the display unit 6 may display animation, 2-D or 3-D images, and digital video playback.

Figure 2:
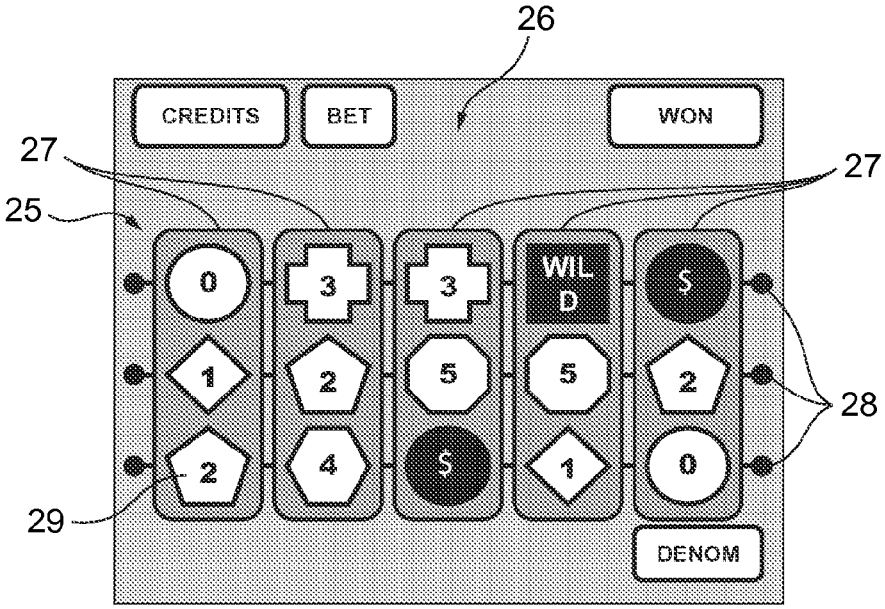
FIG. 2 is an example of the screen displayed by a display unit of the game machine shown in FIG. 1 at the end of game play.

In the present embodiment, as shown in FIG. 2, the display unit 6 displays a cell array 25 having five columns 27 which each contain three cells, and thereby defines 15 cells in which an array of game symbols 29 can be displayed. A static combination of game symbols will be displayed in the cell array 25 at the completion of game play. The static combination of game symbols 29 may include non-winning game symbol combinations where no value payout is awarded to the player, and winning game symbol combinations (i.e., a combination of symbols aligned along one or more pay lines) where value payouts are awarded to the player. The shapes of the game symbols 29 are not particularly limited, and may be a plurality of different objects having different shapes, sizes, or colors, and may also have numbers and/or symbols displayed thereon.

Figure 3:
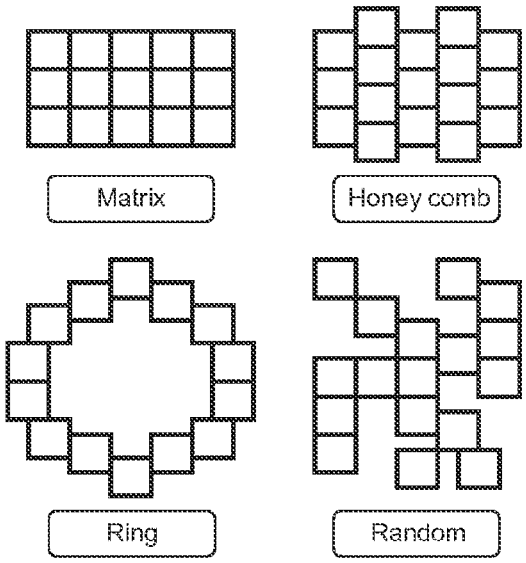
FIG. 3 shows several examples of the cell arrays that can be displayed by the display unit of the game machine shown in FIG. 1.

Note also that the shape of the cell array 25 is not particularly limited. As shown in FIG. 3A-3C, the cell array 25 can take any form, such as a honeycomb shape, a ring shape, or a random shape. In addition, the one or more pay lines used in a game are not limited to horizontal pay lines 28 as shown in FIG. 2, but may take any form that is suitable for the shape of the cell array, such as vertical, diagonal, circular, or any other shape or direction.

The display unit 6 also displays a peripheral region 26 that surrounds the cell array 25.

The game symbols 29 can be displayed in three modes, an animation mode in which the game symbols 29 are animated on the display unit 6, a static mode in which the game symbols 29 are statically displayed in the cells of the cell array 30, and a hybrid mode in which some game symbols 29 are animated on the display unit 6 and other game symbols 29 are statically displayed in some of the cells of the cell array 25. In addition, the game symbols are capable of movement across both the cell array 25 and the peripheral region 26 along a plurality of trajectories (including, but not limited to, horizontal, vertical, diagonal, curved, zig-zag, circular, and other types of trajectories). This aspect of the present invention will be described in greater detail below.

A coin/token deposit opening 8 and a bill slot 9 are provided below the display unit 7 in order to allow a player to insert value for game play (such as coins, tokens, and paper currency). Although not shown in the drawings, the game machine 1 may also include one or more other value input devices that allow a player to insert value for game play. For example, the game machine 1 may also include a card reader which is capable of reading data from a credit or debit card in order to accept value for game play. As used herein, the term "value" may encompass gaming tokens, coins, paper currency, ticket vouchers, credit or debit cards, smart cards, and any other object representative of value.

The game machine 1 may also include a player tracking unit (not shown in the drawings) having a card reader, a keypad, and/or a small display device. The card reader may include any type of card reading device, such as a magnetic card reader, memory card reader, an optical card reader, etc., and may be used to read data from a card (e.g., a credit card, a player tracking card, a smart card, etc.) offered by a player. If provided for player tracking purposes, the card reader may be used to read data from, and/or write data to, cards capable of storing data. Such data may include the identity of a player, the identity of a casino, the player's gaming habits, etc. Once gathered, the data can be used for any number of purposes, including administering player awards, distinguishing player preferences and habits, accounting, etc.

A bet button 10 and a MAX bet button 11 are arranged below the display unit 6, and each function as a bet accepting unit. More specifically, the bet button 10 allows a player to designate a predetermined amount of value as a bet, e.g., a predetermined number of coins stored in a coin storage unit (not shown), or a predetermined number of credits. The MAX bet button 11 allows a player to designate the maximum amount of value allowed as a bet, e.g., the maximum number of coins stored in the coin storage unit, or the maximum number of credits. Note that as used herein, the term "button" is defined to mean any device that allows a player to make an input, such as a mechanical input device that must be depressed, or a touch screen that a player may simply touch.

A spin button 12 is arranged below the display unit 6, and a spin lever 13 is arranged on the right side of the case 2. The spin button 12 and the spin lever 13 both function as starting units, and allow a player to start game play after sufficient value has been input into the game machine 1. A coin payout outlet 15 and a coin receiving tray 16 are disposed on the lower portion of the front panel 3. In the event that a player obtains a winning game symbol combination, a value payout such as coins or tokens will be discharged into the coin receiving tray 16 via the coin payout outlet 15. The game machine 1 could be modified so that this value payout is in the form of paper currency, ticket vouchers, a credit placed on a credit/debit card or smart card, another type of common payment system, or a combination of the above. In addition, a speaker 17 is installed near the coin payout outlet 15, and serves to play voice instructions, music, and/or sound effects to a player before, during, and/or after game play.

A payout button 20, a change button 21, and a help button 22 are arranged near the bet button 10. The payout button 20 allows a player to discharge the coins stored in the coin storage unit when pressed. The change button 21 will light the lamp 4 on the top of the game machine 1 when pressed in order to request assistance, e.g., request coins or tokens in exchange for paper currency. The help button 22 will display, for example, information on how to play a game on the display unit 6 when pressed.

A payout display unit 23 and a credit display unit 24 are arranged below the display unit 6 and above the bet button 10 and the MAX bet button 11. The payout display unit 23 displays the number of coins discharged from the coin payout outlet 15, and the credit display unit 24 displays the number of coins stored in the coin storage unit. The payout display unit 23 and the credit display unit 24 may be implemented as a CRT, an LCD, a plasma display, an organic liquid crystal display, or other type of video display suitable for use in a game machine.

Figure 4:
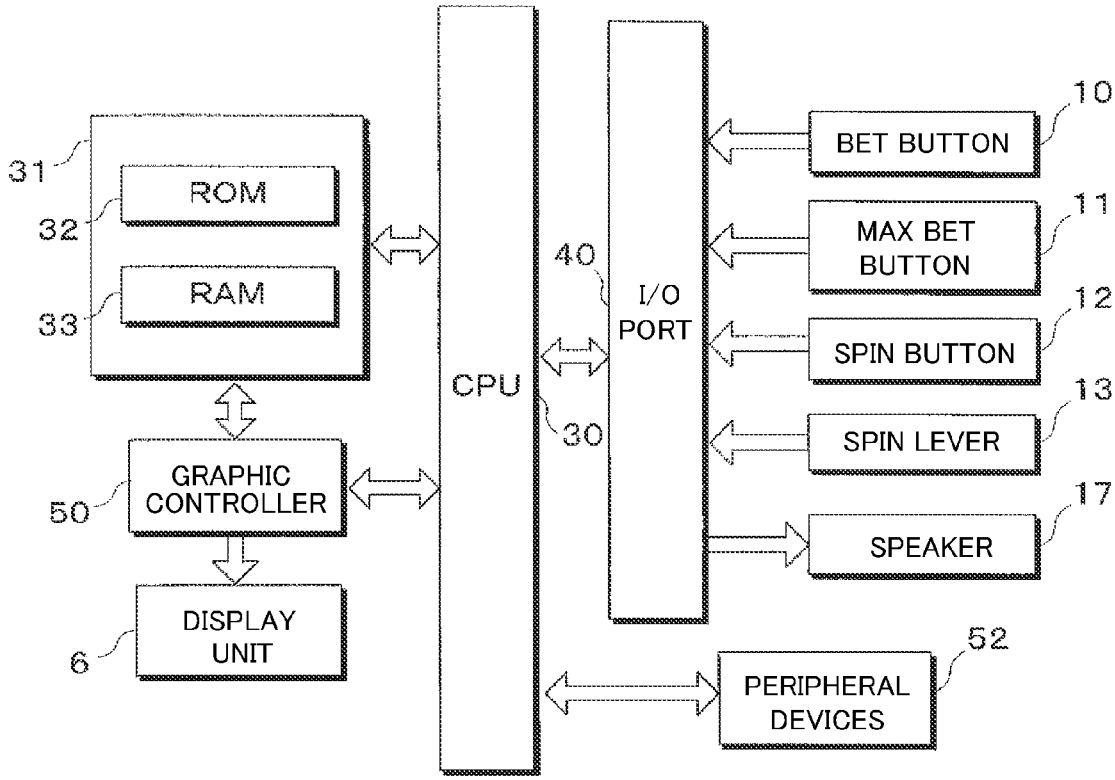
FIG. 4 is block diagram showing the primary electrical configuration of the game machine shown in FIG. 1.

FIG. 4 is a block diagram which shows the primary electrical configuration of the game machine 1. A memory unit 31 comprises a ROM 32 and a RAM 33, and stores event data or other data used or generated during a particular game, as well as one or more software programs (computer-executable instructions) that control the game machine 1 so that it plays a particular game in accordance with applicable game rules. In particular, the memory unit 31 stores software for controlling the operations of the game machine 1, software for producing various visual effects on the display unit 6, software which implements a random number generator, various types of image data to be displayed by the display unit 6 (including data representing each of the game symbols 29 to be displayed by the display unit 6), and one or more pay tables that indicate the correspondences between one or more prizes, specific patterns of game symbols 29, and specific random numbers. The data that represents the game symbols 29 consists of two separate pools of game symbols, a first pool of game symbols from which a static combination of game symbols 29*a* will be selected, and a second pool from which "dummy" game symbols 29*b* will be selected.

More particularly, the memory unit 31 stores software that will perform the following functions:

(1) Select a static combination of game symbols 29*a* to be displayed in the cell array 25 (15 game symbols in this embodiment) from the first pool, based upon a random number generated by the random number generator and an algorithm that determines the static combination of game symbols 29*a* based upon the random number generated. After this selection, the selected static combination of game symbols 29*a* will be divided into a plurality of groups that each consist of one or more game symbols 29. This process will be based upon a random number generated by the random number generator (either the previously generated random number or a new random number), and an algorithm that determines the composition of each group of game symbols based on the random number generated.

(2) Select a plurality of dummy game symbols 29*b* from the second pool, based upon a random number generated by the random number generator and an algorithm that determines the dummy game symbols 29*b* based upon the random number generated. After this selection, the software will then divide the selected dummy game symbols 29*b* into a plurality of groups that each consist of one or more of the selected dummy game symbols 29*b*. This process can be based upon a random number generated by the random number generator (either the previously generated random number or a new random number), and an algorithm that determines the arrangement of the groups of the dummy game symbols 29*b* based on the random number generated. In the alternative, the random number used in the selection and/or division process can be the same random number used to select or divide the static combination of game symbols.

(3) Assign one or more characteristics that each group of game symbols (i.e., the groups that form the static combination of game symbols 29*a* and the groups that form the selected dummy game symbols 29*b*) will exhibit when displayed on the display unit 6. As noted above, the game symbols 29 can along a plurality of trajectories (including, but not limited to, horizontal, vertical, diagonal, curved, zig-zag, circular, and other types of trajectories), and this is one of the characteristics that will be assigned to each group of game symbols. Other possible characteristics that can be assigned to each group of game symbols are the movement of each game symbol 29 relative to the other game symbols 29 in a group, the movement of one group of game symbols relative to one or more other groups of game symbols, and the like. This process can be based upon a random number generated by the random number generator (either the previously generated random number or a new random number), and an algorithm that determines the characteristics of the game symbols 29 based on the random number generated. In the alternative, the random number used in this process can be the same random number used above to select or divide the game symbols.

Note that the random number generator and the algorithms used in this software are not particularly limited, and may be any conventional random number generator and algorithm(s) used in the gaming industry. In addition, some or all of the software may be stored in a remote memory unit outside of the game machine 1, and may therefore control the game machine 1 from a remote location.

A CPU 30 is connected to the memory unit 31, will execute the software stored in the memory unit 31, process data entered through an I/O port 40, and, based on that data, control the various units included in the game machine 1 (including any peripheral devices 52 connected thereto). The CPU 30 also functions as a game control unit. The CPU 30 is connected to the bet button 10, the MAX bet button 11, the spin button 12, the spin lever 13, and the speaker 17 through the I/O port 40. A graphic controller 50 is connected to the memory unit 31, the CPU 30, and the display unit 6, and functions as a display control unit in conjunction with the CPU 30. The graphic controller 50 processes image data stored in the memory unit 31 based on instructions sent from the CPU 30, and then sends the processed image data to the display unit 6 and displays that image data thereon.

Operation of the Game Machine

Figure 5:
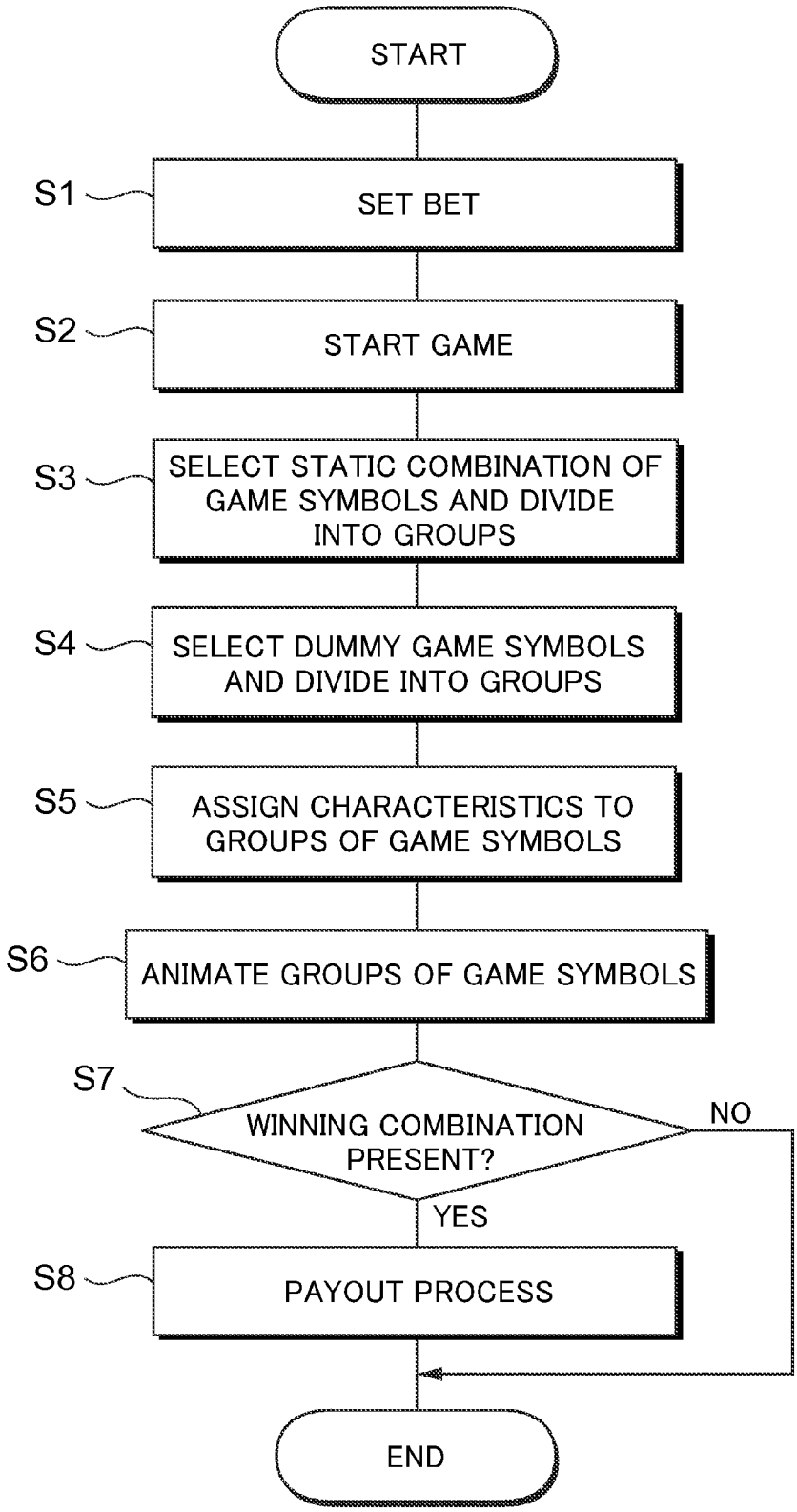
FIG. 5 is a flowchart showing the operations performed by the game machine shown in FIG. 1.

FIG. 5 is a flow chart which shows the overall operation of the game machine 1. In Step S1, a player will enter a bet into the game machine 1 by paying value by means of any one of the methods described above, e.g., inserting one or more coins in the coin slot 8. The player will then press the bet button 10 in order to set the amount of value paid as the bet, or press the MAX bet button 11 in order to set the allowable maximum amount of value as the bet. In addition, after value input detection, the player will be allowed to select a pay line 28.

After the bet is set and the pay line 28 selected, the player will press the spin button 12 or pull the spin lever 13, and thereby generate a start signal which starts game play (Step S2). Upon receipt of the start signal, the CPU 30 will select the static combination of game symbols 29*a* to be displayed in the cell array 25, whether or not a winning combination of game symbols 29 will be displayed in the cell array 25 along the selected pay line 28, the dummy game symbols 29*b* to be displayed by the display unit 6, and the movement characteristics of the game symbols 29 on the display unit 6.

More specifically, in Step S3, the CPU 30 will generate a random number by executing the random number generating software stored in the memory unit 31, and then will use the random number that was generated in an algorithm in order to select, from the first pool, the static combination of game symbols 29*a* to be displayed in the cell array 25. In addition, the generated random number will be looked up in the pay table stored in the memory unit 31, and used to determine whether the static combination of game symbols 29*a* is to include a winning combination of game symbols 29, what that winning combination will be, and what value (if any) will be awarded to the player. After this selection, the CPU 30 will then execute software stored in the memory unit 31 that divides the selected static combination of game symbols 29*a* into a plurality of groups that each consist of one or more of game symbols 29. This operation will be based upon a random number generated by the random number generator, and an algorithm that determines the composition of each group of game symbols based on the random number generated.

In Step S4, the CPU 30 will select a plurality of dummy game symbols 29*b* from the second pool. This selection can be performed by executing the random number generating software stored in the memory unit 31, and then using the random number that was generated in an algorithm that selects the dummy game symbols 29*b* based upon the random number generated. After the selection of the dummy game symbols 29*b*, the software will then divide the selected dummy game symbols 29*b* into a plurality of groups that each consist of one or more game symbols 29. This process will be based upon a random number generated by the random number generator (either the previously generated random number or a new random number), and an algorithm that determines the arrangement of the groups of the dummy game symbols based on the random number generated.

Figure 6:
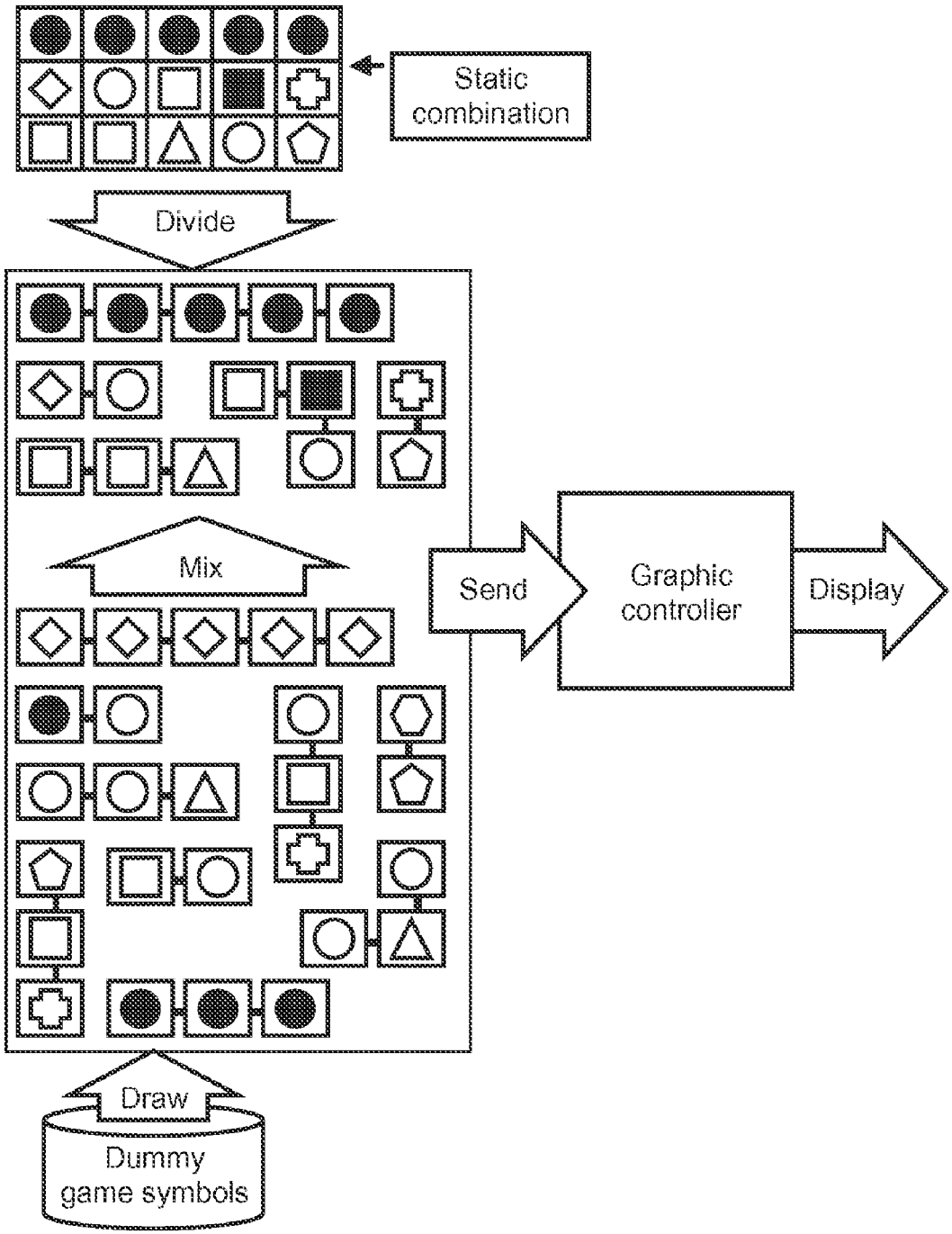
FIG. 6 illustrates a method by which game symbols displayed by the display unit of the game machine shown in FIG. 1 are selected.

An example of the processes of Steps S3 and S4 can be seen in FIG. 6.

In Step S5, the CPU 30 will execute software stored in the memory unit 31 that will assign one or more characteristics that each group of game symbols will exhibit (such as trajectory) when displayed on the display unit 6. This process can, for example, be performed by executing the random number generating software stored in the memory unit 31, and then using the generated random number in an algorithm that assigns the one or more characteristics.

In Step S6, the CPU 30 will begin animating the groups of game symbols selected and divided in Steps S3 and S4 on the display unit 6 (the animation mode noted above), based on the characteristics assigned to them in Step S5. A detailed explanation of the animation mode can be seen in FIGS. 7A-C.

Figure 7A:
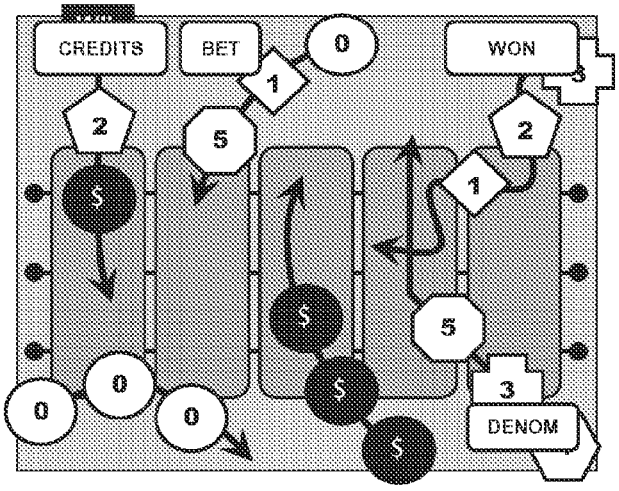
FIG. 7A-C show several sample screens in which the game symbols move on the display unit of the game machine of FIG. 1 during game play.
Figure 7B:
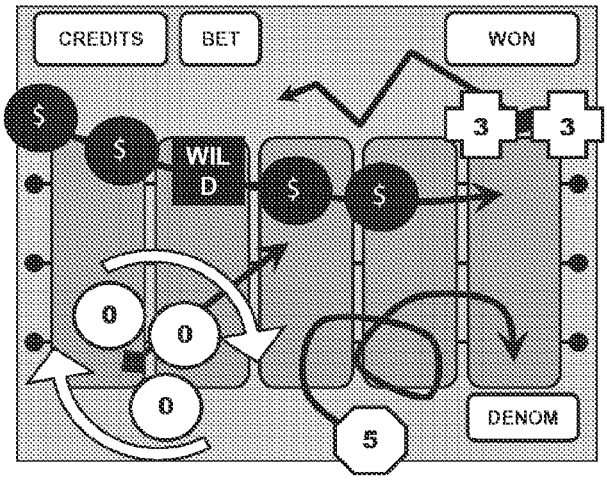
Figure 7C:
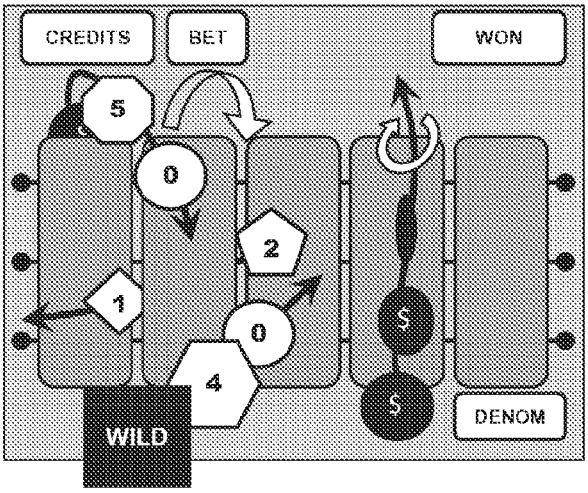

As can be seen in FIGS. 7A-C, the groups of game symbols will begin moving in a variety of trajectories through both the cell array 25 and the peripheral region 26. For example, some groups of game symbols will move in a curved trajectory, other groups of game symbols will move in a zig-zag trajectory, and still others will move in a trajectory that is partially linear and partially curved. Note that the groups of game symbols are capable of moving off the screen of the display unit 6 and then reappear on another part of the screen. Note also that if the display unit 6 is capable of 3D display, the groups of game symbols can move behind the cell array 25, between the columns 27 that form the cell array 25, over or under another group of game symbols, or toward or away from the player (see FIG. 7C). The trajectories of the groups of game symbols are not particularly limited, and may include other trajectories not shown in the drawings.

In addition, each group of game symbols may combine its trajectory with a particular movement (e.g., a twisting movement, a rotational movement, a circular movement, etc.). For example, the groups of game symbols can rotate while moving in a particular trajectory (see, for example, FIG. 7B), or can twist while moving in a particular trajectory (see, for example, FIG. 7C). This type of movement is not particularly limited, and may include other movements not shown in the drawings.

Figure 8A:
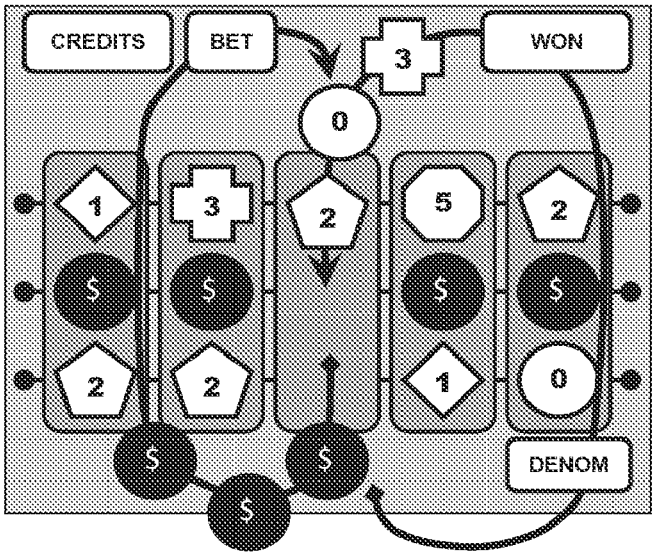
FIG. 8A-B show two sample methods by which the last remaining group of game symbols will occupy the last remaining spaces in the cell array during game play.
Figure 8B:
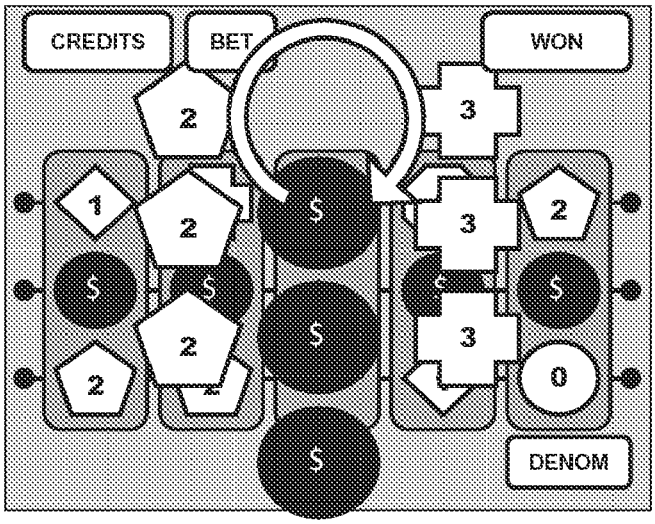

After a predetermined period of time has elapsed, the groups of game symbols that form the static combination of game symbols 29*a* in this embodiment will begin to cease their movement and sequentially stop in the cell array 25, with each group of game symbols coming to stop in each of the 15 cells of the cell array 25 (the hybrid mode noted above). This is illustrated in FIGS. 8A and 8B. As noted above, the groups of dummy game symbols will not stop in the cell array 25, and will continue their trajectory through the cell array 25 and the peripheral region 26 until the 15 cells of the cell array 25 are filled with the static combination of game symbols 29*a*. Once the cell array 25 is filled, the groups of dummy game symbols 29*b* will no longer be displayed by the display unit 6, thereby leaving only the static combination of game symbols 29*a* in the cell array 25. In the alternative, the groups of dummy game symbols 29*b* displayed can be reduced in number as the cell array 25 is filled with the static combination of game symbols 29*a*, with the last group of dummy game symbols 29*b* leaving the screen of the display unit 6 as the last of the static combination of game symbols 29*a* stop in the cells of the cell array 25.

Note that the sequence in which the static combination of game symbols stop in the cells of the cell array 25 is not particularly limited. For example, the game symbols may stop in a sequential manner, for example from left to right and from top to bottom, or may stop in the cell array in a random manner. Software which can execute the desired manner in which the game symbols stop in the cell array is stored in the memory unit 31.

FIGS. 8A and 8B also illustrate two optional methods in which the last portion of the static combination of game symbols 29*a* can be stopped in the cell array 25. In one method, as shown in FIG. 8A, two groups of three game symbols 29 will rotate in sync with each other in order to occupy the last three cells of the cell array 25. In this method, one group of game symbols 29 will form a non-winning combination (e.g., the combination "$-$-0-$-$" as seen in FIG. 8A), and another group of game symbols 29 will form a winning combination (e.g., the combination "$-$-$-$-$" as seen in FIG. 8A). When these two groups of game symbols rotate in this manner in order to occupy the final three cells of the cell array 25, the player will immediately recognize that he or she is close to obtaining a winning combination and winning a prize, but will not know which of the two groups of game symbols 29 will actually occupy the cell array 25. This will increase the level of anticipation during game play, will increase the entertainment value of the game, and will make it more likely that the player will want to play the game again.

In another method, as shown in FIG. 8B, three groups of three game symbols 29 will rotate in sync with each other in order to occupy the last three cells of the cell array 25. However, unlike the previous method, the three groups of game symbols 29 rotate in three dimensions, such that they move toward and away from the player viewing the screen of the display unit 6. Each of two groups of game symbols 29 will form a non-winning combination, and the third group of game symbols 29 will form a winning combination (e.g., the combination "$-$-$-$-$" as seen in FIG. 8B). Like the previous method, when these three groups of game symbols 29 rotate in this manner in order to occupy the final three cells of the cell array 25, the player will immediately recognize that he or she is close to obtaining a winning combination and winning a prize, but will not know which of the three groups of game symbols 29 will actually occupy the cell array 25. This will increase the level of anticipation during game play, will increase the entertainment value of the game, and will make it more likely that the player will want to play the game again.

Referring again to FIG. 5, after the process of Step S6 is completed, i.e., after the static combination of game symbols 29*a* stop in the cell array 25, the CPU 30 will execute the payout process in Step S8 based upon whether or not a winning combination of game symbols 29 are present. The payout process can, of course, be performed by means of a number of different methods, such as dispensing coins or tokens to the coin receiving tray 16, or other method that are known in the art. If no winning combination of game symbols is present, the game will end after the completion of Step S6.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A game machine, comprising:

a display unit;

a memory unit which stores data corresponding to a cell array, a plurality of game symbols and a plurality of dummy game symbols;

a display control unit which displays the cell array, a peripheral region surrounding the cell array, and the plurality of game symbols on the display unit, the display control unit displaying the cell array in an animation mode where each of the plurality of game symbols and the plurality of dummy game symbols moves, a static mode where each of the plurality of game symbols is static and the plurality of dummy game symbols are not displayed, and a hybrid mode where at least one of the plurality of game symbols moves, at least one of the dummy game symbols moves and at least one of the plurality of game symbols is static, the cell array having a plurality of stationary columns, each column having a plurality of game symbol cells, each game symbol cell displaying a single symbol in the static mode, the display control unit animates at least one of the plurality of game symbols and the plurality of dummy game symbols in the hybrid mode, and animates all of the plurality of game symbols and all of the dummy game symbols in the animation mode so that the plurality of game symbols and the plurality of the dummy game symbols are animated and move between the game symbol cells, the columns and across a boundary that separates the cell array from the peripheral region along trajectories that include curved trajectories, and after animating the plurality of game symbols, positions and displays a static combination of game symbols in the cell array with the plurality of dummy game symbols no longer being displayed; and a game control unit which selects the static combination of game symbols to be displayed in the cell array in the static mode, and determines whether a winning combination of game symbols will be included in the static combination of game symbols.

2. The game machine as set forth in claim 1, wherein the game control unit separates the plurality of game symbols into groups each consisting of one or more game symbols, and randomly assigns a trajectory of a different shape to each group of game symbols, each time a player starts game play after placing a bet, the game control unit also separates the plurality of dummy game symbols into groups each consisting of one or more dummy game symbols, and randomly assigns a trajectory of a different shape to each group of dummy game symbols, each time a player starts game play after placing a bet, the display control unit animates the plurality of game symbols on a group-by-group basis so that the individual groups of game symbols move along trajectories whose shapes vary with the different groups of game symbols, and the display control unit also animates the plurality of dummy game symbols on a group-by-group basis so that the individual groups of dummy game symbols move along trajectories whose shapes vary with the different groups of dummy game symbols.

3. The game machine as set forth in claim 2, wherein the display control unit is configured such that the groups of game symbols selected to be the static combination of game symbols ceasing their movement, sequentially stopping in corresponding cells of the cell array thereby displaying the static combination of game symbols.

4. The game machine as set forth in claim 1, wherein the game control unit mixes the static combination of game symbols with the plurality of dummy game symbols at the moment that a player starts game play after placing a bet.

5. The game machine as set forth in claim 4, wherein the game control unit randomly separates the static combination of game symbols into groups each consisting of one or more game symbols, and randomly separates the plurality of dummy game symbols into groups each consisting of one or more game symbols, prior to mixing the static combination of game symbols with the plurality of dummy game symbols.

6. The game machine as set forth in claim 1, wherein the game control unit randomly separates the plurality of game symbols into groups each consisting of one or more game symbols each time a player starts game play after placing a bet, the game control unit also randomly separates the plurality of dummy game symbols into groups each consisting of one or more dummy game symbols each time a player starts game play after placing a bet, the display control unit animates the plurality of game symbols on a group-by-group basis so that the plurality of game symbols move on the display unit independent of each other and/or in groups of two or more, and the display control unit also animates the plurality of dummy game symbols on a group-by-group basis so that the plurality of dummy game symbols move on the display unit independent of each other and/or in groups of two or more.

7. The game machine as set forth in claim 6, wherein the display control unit animates a group of two or more game symbols so that each game symbol in the group moves with respect to the other game symbols in the group.

8. The game machine as set forth in claim 6, wherein the display control unit is configured such that the groups of game symbols selected to be the static combination of game symbols ceasing their movement, sequentially stopping in corresponding cells of the cell array thereby displaying the static combination of game symbols.

9. The game machine as set forth in claim 1, wherein the display control unit displays a virtual three-dimensional space on the display unit, and animates the plurality of game symbols within the virtual three-dimensional space so that the plurality of game symbols move behind the cell array, between the columns included in the cell array, over or under another game symbols, or toward or away from a player.

10. The game machine as set forth in claim 9, wherein the display control unit animates the plurality of game symbols so as to add at least one movement within the virtual three-dimensional space that is selected from the group consisting of revolving, rotating, twisting, and zig-zagging to the plurality of game symbols.

11. The game machine as set forth in claim 1, wherein the display control unit animates the plurality of game symbols so that the last portion of the static combination of game symbols and the dummy game symbols alternately move across the last cells of the cell array after other portions of the static combination of game symbols have been positioned and displayed in other cells of the cell array.

12. The game machine as set forth in claim 1, wherein the display control unit displays a virtual three-dimensional space on the display unit, and the display control unit animates the plurality of game symbols within the virtual three-dimensional space so that the last portion of the static combination of game symbols and the dummy game symbols rotate toward and away from a player, thereby being alternately place in the last cells the cell array after other portions of the static combination of game symbols have been positioned and displayed in other cells of the cell array.

13. The game machine as set forth in claim 1, wherein the display control unit is configured to animate the plurality of game symbols sequentially ceasing movement and stopping in corresponding cells of the cell array and displaying the plurality of dummy symbols leaving the cell array and no longer being displayed as the plurality of game symbols cease movement.

14. A computer readable medium having computer-executable instructions for performing steps comprising:

displaying a cell array in an animation mode where each of a plurality of game symbols and a plurality of dummy symbols moves, a static mode where each of the plurality of game symbols is static and the plurality of dummy game symbols are not displayed, and a hybrid mode where at least one of the plurality of game symbols moves, at least one of the plurality of dummy game symbols moves and at least one of the plurality of game symbols is static, the cell array having a plurality of stationary columns, each column having a plurality of game symbol cells, each game symbol cell displaying a single symbol in the static mode, a peripheral region surrounding the cell array and a plurality of game symbols on a display unit;

animating at least one of the plurality of game symbols and one of the plurality of dummy game symbols in the hybrid mode and animating all of the plurality of game symbols and all of the plurality of dummy game symbols in the animation mode on the display unit so that the game symbols being animated move between the game symbol cells, the columns and across a boundary that separates the cell array from the peripheral region along a plurality of linear and/or non-linear trajectories;

selecting a static combination of game symbols to be displayed in the cell array from the plurality of game symbols; and positioning and displaying the static combination of game symbols in the cell array after the animating step.

15. The readable recording medium as set forth in claim 14, wherein the computer-executable instructions separate the plurality of game symbols into groups each consisting of one or more game symbols, and randomly assigns a trajectory of a different shape to each group of game symbols each time a player starts game play after placing a bet, the computer-executable instructions also separate the plurality of dummy game symbols into groups each consisting of one or more dummy game symbols, and randomly assigns a trajectory of a different shape to each group of dummy game symbols each time a player starts game play after placing a bet, the computer-executable instructions animate the plurality of game symbols on a group-by-group basis so that individual groups of game symbols move along trajectories whose shapes vary with the different groups of game symbols, and the computer-executable instructions also animate the plurality of dummy game symbols on a group-by-group basis so that individual groups of dummy game symbols move along trajectories whose shapes vary with the different groups of dummy game symbols.

16. The readable recording medium as set forth in claim 15, further including displaying the groups of game symbols selected to be the static combination of game symbols ceasing their movement and sequentially stopping in corresponding cells of the cell array thereby displaying the static combination of game symbols.

17. The readable recording medium as set forth in claim 14, wherein the computer-executable instructions mix the static combination of game symbols with the plurality of dummy game symbols at the moment that a player starts game play after placing a bet.

18. The readable recording medium as set forth in claim 17, wherein the computer-executable instructions randomly separate the static combination of game symbols into groups consisting of one or more game symbols, and randomly separate the plurality of dummy game symbols into groups of one or more game symbols, prior to mixing the static combination of game symbols with the plurality of dummy game symbols.

19. The readable recording medium as set forth in claim 14, wherein the computer-executable instructions randomly separate the plurality of game symbols into groups each consisting of one or more game symbols each time a player starts game play after placing a bet, the computer-executable instructions also randomly separate the plurality of dummy game symbols into groups each consisting of one or more dummy game symbols each time a player starts game play after placing a bet, the computer-executable instructions animate the plurality of game symbols on a group-by-group basis so that the plurality of game symbols move on the display unit independent of each other and/or in groups of two or more, and the computer-executable instructions also animate the plurality of dummy game symbols on a group-by-group basis so that the plurality of dummy game symbols move on the display unit independent of each other and/or in groups of two or more.

20. The readable recording medium as set forth in claim 19, wherein the computer-executable instructions animate a group of two or more game symbols so that each game symbol in the group moves with respect to the other game symbols in the group.

21. The readable recording medium as set forth in claim 19, further including displaying the groups of game symbols selected to be the static combination of game symbols ceasing their movement and sequentially stopping in corresponding cells of the cell array thereby displaying the static combination of game symbols.

22. The readable recording medium as set forth in claim 14, wherein the computer-executable instructions display a virtual three-dimensional space on the display unit, and animate the plurality of game symbols within the virtual three-dimensional space so that the plurality of game symbols move behind the cell array, between columns included in the cell array, over or under another game symbols, or toward or away from a player.

23. The readable recording medium as set forth in claim 22, wherein the computer-executable instructions animate the plurality of game symbols so as to add at least one movement within the virtual three-dimensional space that is selected from the group consisting of revolving, rotating, twisting, and zig-zagging to the plurality of game symbols.

24. The readable recording medium as set forth in claim 14, wherein the computer-executable instructions animate the plurality of game symbols so that the last portion of the static combination of game symbols and the dummy game symbols alternately move across the last cells of the cell array, after other portions of the static combination of game symbols have been positioned and displayed in other cells of the cell array.

25. The readable recording medium as set forth in claim 14, wherein the computer-executable instructions display a virtual three-dimensional space on the display unit, and the computer-executable instructions animate the plurality of game symbols within the virtual three-dimensional space so that the last portion of the static combination of game symbols and the dummy game symbols rotate toward and away from a player, thereby being alternately placed in the last cells of the cell array, after other portions of the static combination of game symbols have been positioned and displayed in other cells of the cell array.

26. The readable recording medium as set forth in claim 14, further including after selecting the static combination of game symbols, displaying the plurality of game symbols sequentially ceasing movement and stopping in corresponding cells of the cell array and displaying the plurality of dummy symbols leaving the cell array and no longer being displayed as the plurality of game symbols cease movement.

* * * * *